United States Patent [19]

Grimstad et al.

[11] Patent Number: 4,878,255

[45] Date of Patent: Nov. 7, 1989

[54] ADJUSTABLE HINGE ASSEMBLY

[75] Inventors: Ronald N. Grimstad, Sheboygan; Michael F. Daly, Manitowoc, both of Wis.

[73] Assignee: Kohler Co., Kohler, Wis.

[21] Appl. No.: 132,342

[22] Filed: Dec. 14, 1987

[51] Int. Cl.[4] ..... A47K 13/12

[52] U.S. Cl. ..... 4/236; 16/249; 16/380

[58] Field of Search ..... 4/236, 240; 411/187, 411/545, 542; 16/249, 380

[56] References Cited

U.S. PATENT DOCUMENTS

| | | | |
|---|---|---|---|
| 503,728 | 8/1893 | Smith . | |
| 566,323 | 8/1896 | Kelleher et al. . | |
| 629,699 | 7/1899 | McQueen | 411/545 |
| 2,027,888 | 1/1936 | Solomon | 16/130 |
| 2,086,211 | 7/1937 | Campbell | 4/236 |
| 2,448,330 | 8/1948 | Sperzel . | |
| 2,846,697 | 8/1958 | Phillips | 4/240 |
| 3,019,472 | 2/1962 | Wasmuth | 16/129 |
| 3,308,483 | 3/1967 | Miller | 4/236 |
| 3,526,907 | 9/1970 | Stairs | 4/236 |
| 3,590,401 | 7/1971 | Brown | 4/236 |
| 3,670,441 | 6/1972 | Blount | 4/236 |
| 4,080,671 | 3/1978 | Stähli | 4/236 |
| 4,087,884 | 5/1978 | Seiderman | 4/236 |
| 4,159,548 | 7/1979 | Hewson | 4/236 |
| 4,438,535 | 3/1984 | Paredes | 4/234 |
| 4,467,481 | 8/1984 | Ginsburg | 4/236 |
| 4,479,273 | 10/1984 | Raden et al. | 4/253 |

FOREIGN PATENT DOCUMENTS

| | | |
|---|---|---|
| 1067651 | 12/1979 | Canada . |
| 2297026 | 1/1976 | France . |
| 1116517 | 6/1968 | United Kingdom . |

*Primary Examiner*—Linda J. Sholl

*Attorney, Agent, or Firm*—Quarles & Brady

[57] ABSTRACT

A hinge assembly for adjustably mounting a toilet covering member to the rear of a toilet is disclosed. In one form, a hinge block has a compartment with serrations to adjustably receive a bushing with complementary serrations. A mounting bolt is placed through an opening in the hinge block and the bushing for engagement with a nut to secure the hinge assembly to the toilet. In one embodiment, the hinge block supports opposing hinge brackets for the toilet covering member with the hinge pin trapped by the mounting of one of the brackets. In an especially preferred form, the hinge assembly is employed with a cover and a toilet having matching curved front portions.

4 Claims, 4 Drawing Sheets

ADJUSTABLE HINGE ASSEMBLY

BACKGROUND OF THE INVENTION

1. Field of the Invention

This invention relates to adjustable hinges for mounting toilet covering members (e.g. toilet covers and toilet seats) to toilets.

2. Description of the Prior Art

Modern toilet designs have placed new demands on toilet covering hinge assemblies. In many instances it is desired for aesthetic reasons to precisely match the geometry of the toilet basin with the toilet cover. This is a problem when vitreous china toilets are involved as manufacturing variations must be accommodated. These variations are in many cases quite small, which means that adjustments must be capable of finite adjustment.

In addition to providing for adjustment, a hinge assembly of this type should be capable of easy removal and installation. It is also desirable that such hinge assemblies secure the toilet covering members on the toilet without excessive looseness or play in the hinge joint. Further, the toilet covering members should not be susceptible to accidental dismounting or be unduly expensive to produce.

In keeping with aesthetic objectives and to minimize the risk of vandalism in public or quasi-public (e.g. in hotel rooms) restrooms, it is also desirable that the connection between the toilet coverings and the toilet be hidden in at least some positions of the cover members.

SUMMARY OF THE INVENTION

In one form, the invention provides a hinge assembly for adjustably mounting a toilet covering member to the rearward portion of a toilet. The toilet is of the type having at least one fastening opening extending downwardly in the rearward portion. A bushing is positionable in the fastening opening and has a throughbore. A hinge block is mountable over the bushing and an opening in the hinge block is alignable with the bushing throughbore. A fastener extends into the hinge block opening and the bushing throughbore to assist in connecting the hinge block and bushing to the toilet. Recess and projection means extend between the hinge block and bushing so that the hinge block may be fixed relative to the bushing and thus the toilet front at at least two different positions.

In a preferred form, the projection means are represented by grooves on both an upper surface of the bushing and a lower surface of the hinge block with the surfaces having multiple grooves in the form of serrations.

In another embodiment, the toilet cover hinge assembly is employed in conjunction with a toilet cover having a pocket formed in its lower rearward portion. There is also means for rotatably coupling the hinge post to the toilet cover. Preferably the coupling means includes a headed hinge post bracket mounting means formed from an "L"-shaped bracket which has a first hole for receiving the hinge post and a second hole for receiving the bracket mounting means to mount the bracket to the toilet covering whereby the hinge post may be inserted in the first bracket hole and the hinge block post and trapped in the pocket by the mounting of the bracket on the toilet cover.

It is therefore a principal object of the invention to provide a toilet covering hinge assembly which can afford adjustment of toilet covering members in two directions.

It is another object of the invention to provide a toilet covering hinge assembly which enables quick yet secure assembly.

It is another object of the invention to provide a toilet covering hinge assembly which employs a minimum number of parts and is inexpensive to produce.

It is another object of the invention to provide a toilet covering hinge assembly which is especially suited to position a curved toilet cover with respect to a curved front wall of the toilet basin.

It is another object of the invention to provide a toilet covering hinge assembly which can be manufactured without special tooling.

The foregoing and other objects and advantages of the invention will appear in the following detailed description. In the description, reference is made to the accompanying drawings which show, by way of illustration and not limitation, a preferred embodiment of the invention.

DETAILED DESCRIPTION OF THE PREFERRED EMBODIMENTS

Figure 1:
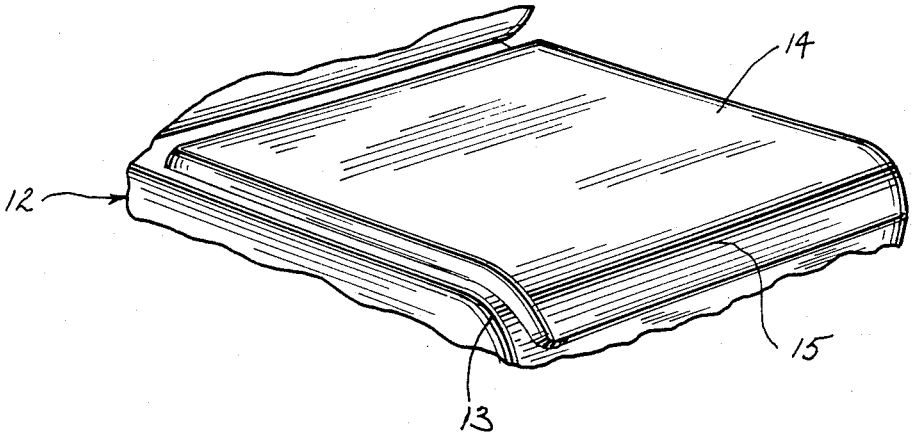
FIG. 1 is a perspective view of a portion of a toilet which is shown with both toilet coverings in the down position.
Figure 2:
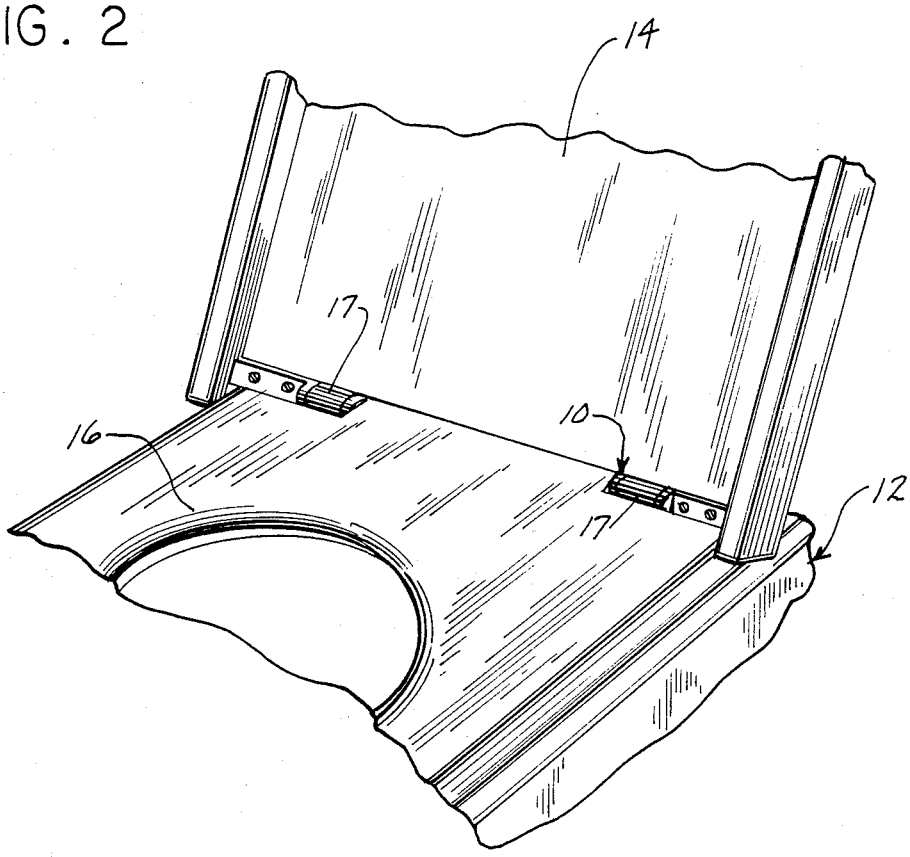
FIG. 2 is a perspective view of a portion of the toilet of FIG. 1 shown with the toilet cover in the "up" position and the toilet seat in the "down" position.

Referring to FIGS. 1 and 2, a hinge assembly 10 of the invention is shown mounted to the rear of a toilet 12. The toilet 12 shown is a low profile streamline toilet which has a curved front area 13 and a cover 14 with a curved front 15. In order to better match the frontal curves of the cover 14 and toilet 12 it is desirable to provide a front to back adjustment for the cover 14.

Figure 3:
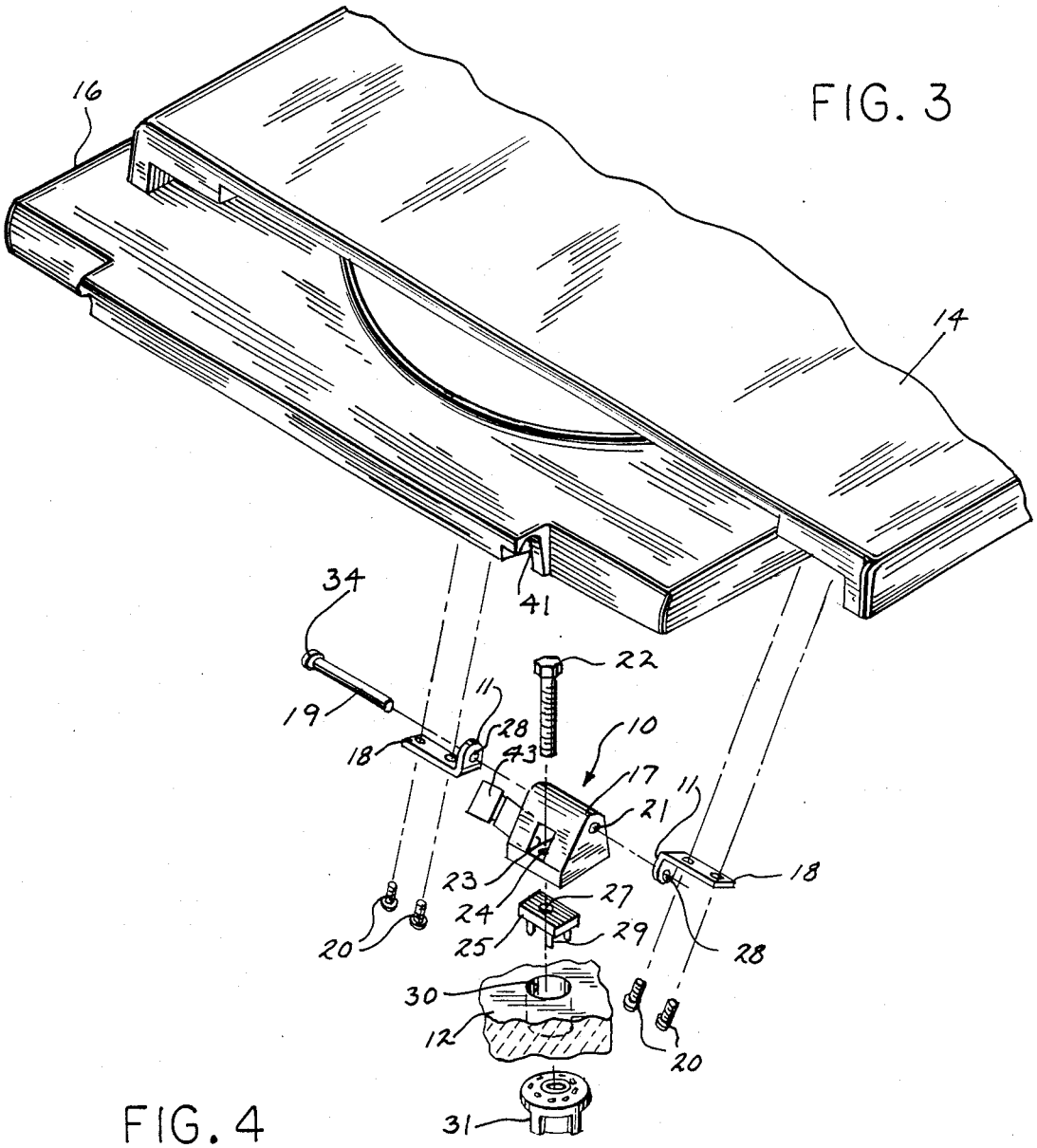
FIG. 3 is an exploded perspective view illustrating a hinge assembly of this invention, with the coverings and toilet shown in fragmentary fashion.

Referring to FIG. 3, one of the two hinge assemblies 10 is shown in conjunction with the cover 14 and the toilet seat 16. The hinge assembly includes a hinge block 17 having a throughbore 21 for receiving hinge pin 19. The hinge pin also passes through the openings 28 of the flange portions 11 of the two "L"-shaped hinge brackets 18. These brackets are mounted to the cover 14 and the toilet seat 16 by the screws 20. The head 34 of the hinge pin 19 is positioned in the undercut or pocket portion 41 of the toilet seat 16 so as to be captively held therein when a hinge bracket is fastened to the toilet seat 16.

The hinge block 17 has a rectangular opening 23 at the top, back as well as a throughbore 24 which is an extension thereof through the base of the block to receive the headed mounting bolt 22 therethrough.

Figure 4:
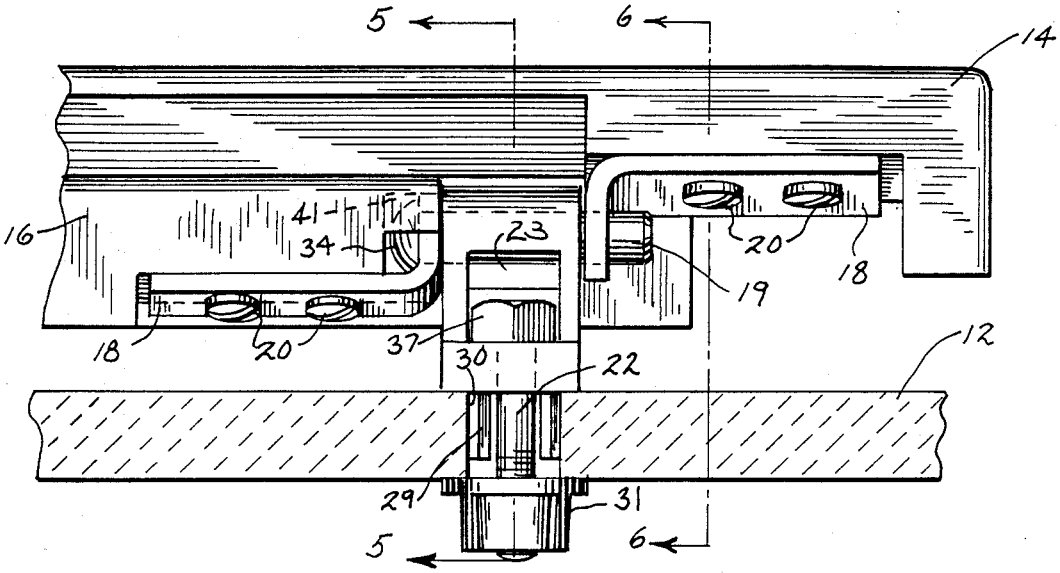
FIG. 4 is an enlarged detail view, partially in vertical section, of the assembled structure with both covers down taken from the rear.

A bushing 25 with resilient feet 29 is designed to be jammed in conventional holes 30 in the back of the toilet 12 which will have a recess (not shown) so as to receive the hinge block. The bushing 25 has an opening 27 through which the mounting bolt also passes. A winged nut 31 receives the mounting bolt 22 at the underside of the toilet 12. This is best seen in FIG. 4.

Figure 5:
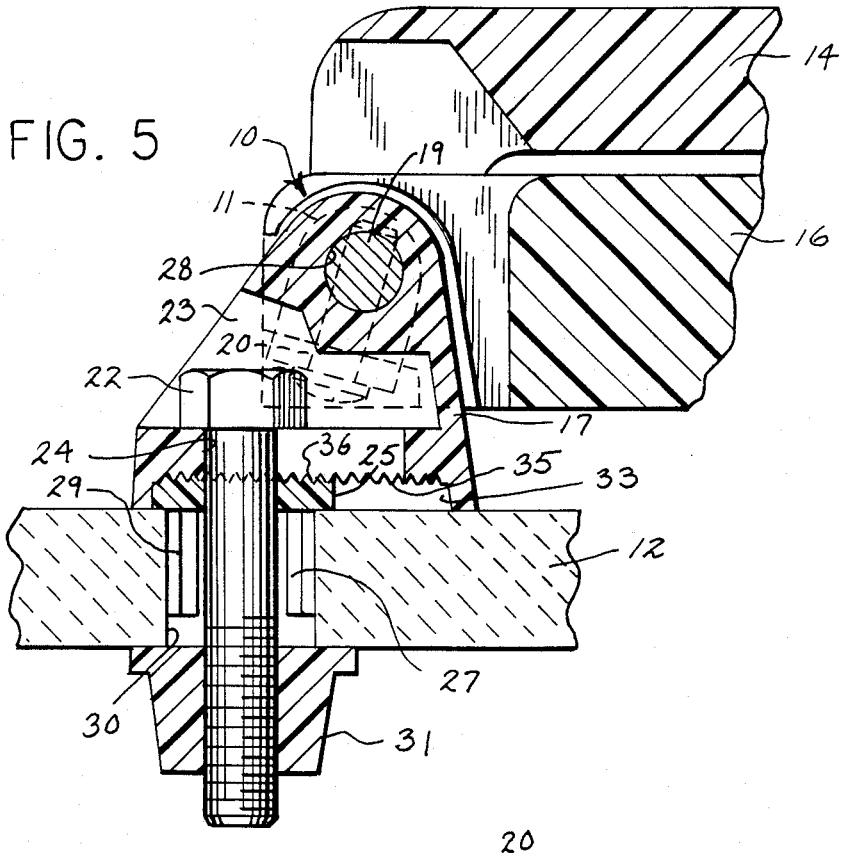
FIG. 5 is a sectional view taken along line 5—5 of FIG. 4.
Figure 6:
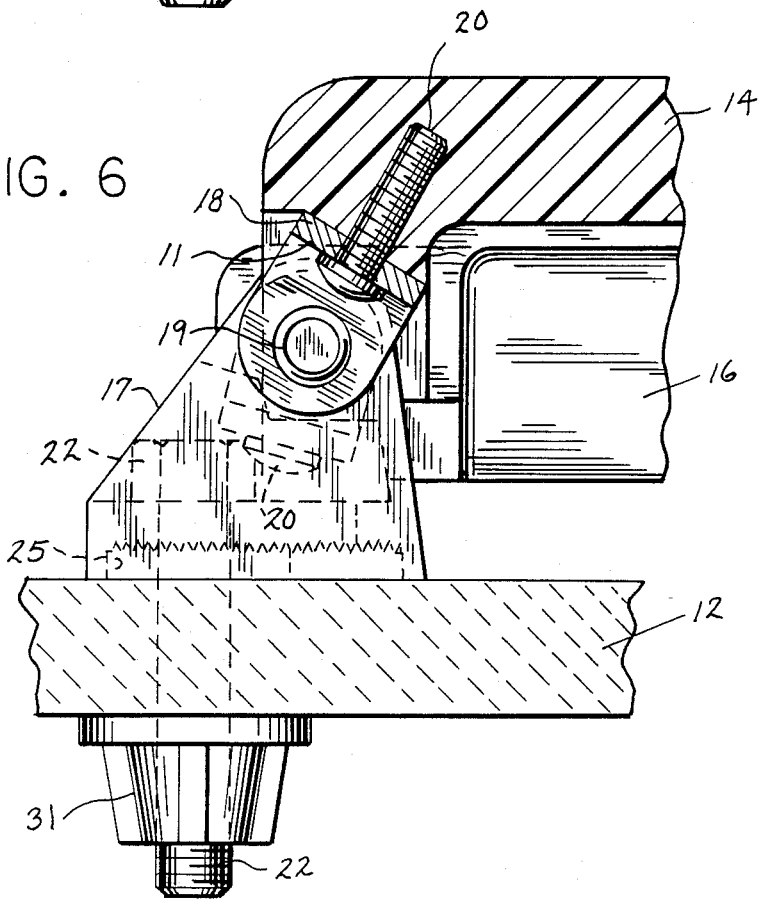
FIG. 6 is a sectional view taken along line 6—6 of FIG. 4.

Referring to FIG. 5, it will be seen that the hinge block 17 has a cavity 33 for receiving the bushing 25. Note further that the cavity is provided by a compartment and the compartment 33 and bushing 25 have the complementary serrations 35 and 36 respectively. This permits the cover 14 as well as the seat 16 to be moved fore and aft of the toilet for adjustment purposes. It will be appreciated that two of such hinge assemblies 10 will be utilized so that previously indicated adjustment can be made to both sides of the coverings with respect to the toilet 12 or either side separately.

To install the assembly, the hinge brackets 18 will be preassembled to the cover 14 and the toilet seat 16 by the screws 20 with the head 34 of the hinge pin 19 captively held in the pocket 41 of the toilet seat 16. The bushing 25 with the foot portions 29 are then jammed in the opening 30 at the back of the toilet 12. The bolt 22 is then placed through the openings 23, and 24, and opening 27. The nut 31 is then screwed onto the bolt 22 to result in the cover 14 and the seat 16 being fastened to the toilet 12 as shown in FIG. 4.

One of the advantages of the hinge assembly and the opening 23 is that the head 37 of the mounting screw 22 is designed so that the opposing flats of the hexagonal head 37 are trapped in the rectangular opening 23 so that they cannot rotate any substantial distance. This provides a wrench effect for permitting easier fastening or loosening of the nut 31.

Figure 7:
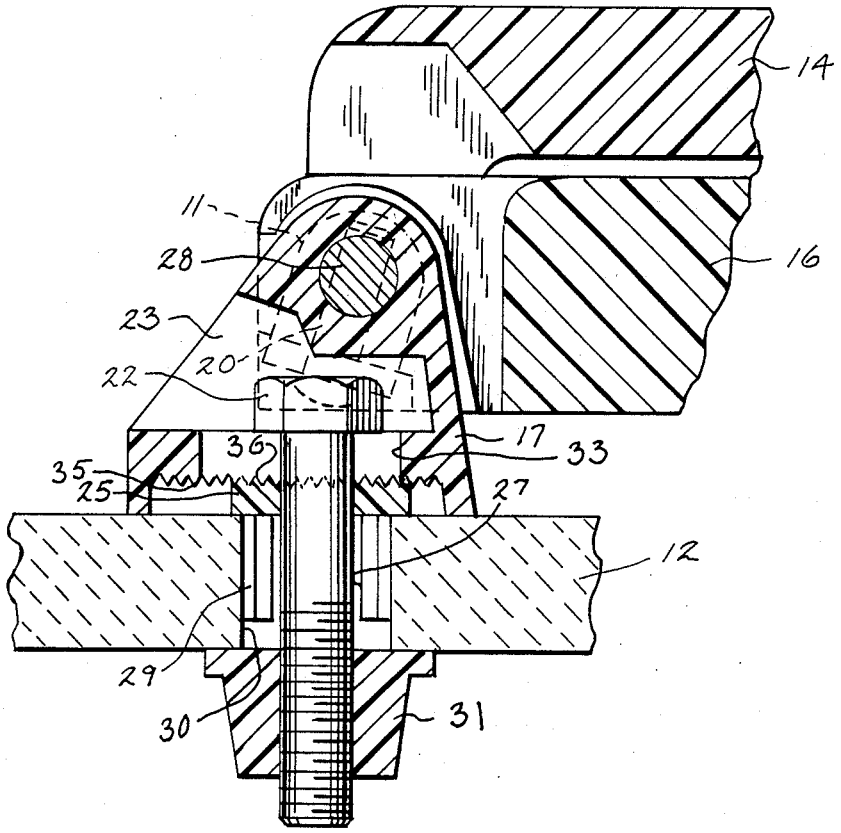
FIG. 7 is a view similar to FIG. 5, but with the hinge block moved rearward.

Referring specifically to FIG. 5, it is seen that the bushing 25 is of a shorter front to back dimension with respect to the toilet 12 than the cavity 33 in the hinge block 17. This allows for adjustment of the hinge block 17 with respect to the bushing 25 and the opening 30. Compare FIGS. 5 and 7.

The serrations 35 and 36 afford a frictional engagement in conjunction with the nut 31 and the screw 22 fastening to thereby adjustably secure the cover 14 and the seat 16 to the toilet 12. These assist in preventing movement of the two parts with respect to each other when the nut 31 is secured to the screw 22 to effect the resulting clamping action between the two parts. While the serrations 35 and 36 are the preferred frictional engagement means between the hinge block 17 and the bushing 25 it will be appreciated that any type of similar recess and projection engagement could be afforded, such as with complementary ribs or roughened surfaces.

Referring specifically to FIG. 3, it is seen that a cover 43 can be placed over the opening 23 in the hinge block 17. This will be done after the mounting 22 is placed through and into the opening 23. This affords a sanitary feature as well as an aesthetic one.

The hinge assembly 10 is easily attached or detached from a toilet 12. Yet, it affords an attachment which is substantially hidden from view.

The hinge block 17, the bushing 25 and the wing nut 31 are preferably composed of a polypropylene resinous material. This also aids in the disassembly of the hinge assembly in that it affords a corrosion resistant attachment. The resilient properties of this material also aid in the clamping action of the fastening means.

While the hinge port and bushing are described with a particular bracket members 18 and hinge pin 19, it is apparent that they could readily be used with various other types of attachment and hinge members, albeit the entrapment of the head 34 in the undercut 41 is advantageous.

Four foot portions 29 are illustrated for extending from bushing 25. Any number could be utilized, or they could be formed with barbs, or they could be formed as a solid cylindrical portion for seating in opening 30. The cover feature 43 is entirely optional. Therefore, the invention is not intended to be limited by the specific description or drawings of the preferred embodiments, but rather by the claims which follow.

I claim:

1. A toilet cover assembly for adjustably mounting a toilet covering member to the rearward portion of a toilet, the toilet being of the type having at least one fastening opening extending downwardly in said rearward portion, said assembly comprising:

a toilet cover having a pocket formed in its lower rearward portion;

a bushing positionable in said fastening opening, said bushing having a throughbore;

a hinge block mountable over said bushing and having a substantially horizontal hinge post receiving bore;

a hinge post insertable in the hinge post receiving bore, said hinge post including an enlarged head at a first end;

an opening in said hinge block alignable with said bushing throughbore;

a fastener extendable into said hinge block opening and bushing throughbore to assist in connecting the hinge block and bushing to said toilet;

recess and projection means extending between said hinge block and bushing whereby said block may be fixed relative to said bushing at at least two different positions; and mountable bracket means for rotatably coupling said hinge post and said hinge block to said toilet cover, said mountable bracket means coupling said hinge post to said toilet cover such that said enlarged head of said hinge post is captured in said pocket.

2. The assembly of claim 1 wherein the recess and projection means are grooves on both an upper surface of the bushing and a lower surface of the hinge block.

3. The assembly of claim 2, wherein both of said surfaces have multiple grooves in the form of serrations.

4. The assembly of claim 3 wherein said mountable bracket means includes:

an "L"-shaped bracket having a hole on each arm of the "L", a first hole for receiving the hinge post and a second hole for receiving mounting means to mount the bracket to the toilet covering member whereby the hinge post may be inserted in said first bracket hole and said hinge block post receiving bore, and trapped in said pocket by the mounting of said bracket on said toilet covering member.

* * * * *